US006702629B2

(12) United States Patent
Adamczyk

(10) Patent No.: US 6,702,629 B2
(45) Date of Patent: Mar. 9, 2004

(54) WATERCRAFT WITH IMPROVED STABILITY

(75) Inventor: Rick Adamczyk, St. Cloud, FL (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 10/207,004

(22) Filed: Jul. 30, 2002

(65) Prior Publication Data

US 2003/0003819 A1 Jan. 2, 2003

Related U.S. Application Data

(63) Continuation-in-part of application No. 09/635,262, filed on Aug. 9, 2000.

(60) Provisional application No. 60/168,676, filed on Dec. 3, 1999, and provisional application No. 60/308,836, filed on Aug. 1, 2001.

(30) Foreign Application Priority Data

Aug. 9, 1999 (CA) ..... 2279804

(51) Int. Cl.[7] ..... B63H 11/00

(52) U.S. Cl. ..... 440/38; 440/42

(58) Field of Search ..... 440/38, 40–43, 440/47

(56) References Cited

U.S. PATENT DOCUMENTS

| | | | | |
|---|---|---|---|---|
| 2,713,841 A | | 7/1955 | Forbes | |
| 2,766,714 A | | 10/1956 | Hammers | |
| 3,290,706 A | | 12/1966 | Hale | |
| 3,428,976 A | | 2/1969 | Robinson | |
| 3,811,143 A | | 5/1974 | Page | |
| 3,811,397 A | * | 5/1974 | Usborne | 440/47 |
| 3,823,431 A | | 7/1974 | Miller | |
| 3,949,700 A | | 4/1976 | Baroody | |
| 4,033,280 A | | 7/1977 | Wood et al. | |
| 4,040,693 A | | 8/1977 | Peterson et al. | |
| 4,742,795 A | | 5/1988 | DePrey et al. | |
| 4,883,016 A | | 11/1989 | Larson | |
| 4,957,056 A | | 9/1990 | Martin | |
| 5,029,348 A | | 7/1991 | Boren | |
| 5,095,843 A | | 3/1992 | Kobayashi et al. | |
| 5,123,372 A | | 6/1992 | Kobayashi et al. | |
| 5,136,963 A | | 8/1992 | Zuzik | |
| 5,143,013 A | | 9/1992 | Huebner | |
| 5,150,663 A | | 9/1992 | Kobayashi | |
| 5,237,950 A | | 8/1993 | Abe et al. | |
| 5,331,917 A | | 7/1994 | Magers | |
| 5,349,919 A | | 9/1994 | Douglass | |
| 5,355,826 A | | 10/1994 | Hattori et al. | |
| 5,366,028 A | | 11/1994 | Kobayashi | |
| 5,416,670 A | | 5/1995 | Authier | |
| 5,490,474 A | | 2/1996 | Ikeda | |
| 5,537,948 A | | 7/1996 | Kobayashi | |
| 5,566,637 A | | 10/1996 | Benza | |
| 5,572,944 A | | 11/1996 | Slikkers et al. | |
| 5,915,329 A | | 6/1999 | Watkins et al. | |
| 5,984,740 A | * | 11/1999 | Ikeda et al. | 440/38 |
| 6,062,922 A | * | 5/2000 | Nanami | 440/38 |
| 6,071,156 A | * | 6/2000 | Platzer et al. | 440/42 |
| 6,168,481 B1 | | 1/2001 | Mardikian | |
| 6,236,826 B1 | | 5/2001 | Kurz et al. | |

FOREIGN PATENT DOCUMENTS

JP 4-133894 A * 5/1992

* cited by examiner

*Primary Examiner*—Sherman Basinger
(74) *Attorney, Agent, or Firm*—Pillsbury Winthrop LLP

(57) ABSTRACT

A watercraft, equipped with a jet drive power source, with improved stability is disclosed. The jet drive power source is configured to produce power along a predetermined direction and form a drive line based upon the predetermined direction. The drive line bisects a plane of the keel at a predetermined angle that is less than about 4 degrees. The drive shaft and the output shaft are not substantially parallel.

30 Claims, 4 Drawing Sheets

WATERCRAFT WITH IMPROVED STABILITY

This application is a continuation-in-part of U.S. Non-provisional Patent Application Ser. No. 09/635,262, filed on Aug. 9, 2000, now pending, which is incorporated herein by reference. This application also claims the benefit of U.S. Provisional Patent Application Ser. No. 60/168,676, filed Dec. 3, 1999, and Canadian Application No. 2,279,804, filed Aug. 9, 1999, both of which are incorporated herein by reference. The parent application (Ser. No. 09/635,262) relies on these two applications for priority. In addition, this application relies for priority on U.S. Provisional Patent Application Ser. No. 60/308,836, filed on Aug. 1, 2001, the contents of which are incorporated herein by reference.

FIELD OF THE INVENTION

This invention relates to watercraft and more particularly to watercraft with improved stability.

DESCRIPTION OF THE RELATED ART

Various types of watercraft exist, each being suited for different types of activities. For example, a pontoon-type watercraft is designed for slower speeds and general recreational use and is typically powered by an outboard engine. In contrast, sport boats and personal watercraft are designed for higher speeds and superior handling and are powered typically by inboard jet drive systems, which consist of an inboard engine and a jet propulsion unit.

In a conventional sport boat, the engine is mounted above a jet propulsion unit. The intake for the jet propulsion unit is located beneath the watercraft and the exhaust, or jet port, is located at the rear of the watercraft.

There are several parameters that are engineered into a sport boat that may affect its performance. One of those parameters is the "drive line angle," which is the angle measured between the primary drive shaft (attached to the impeller) and the keel line of the watercraft.

Due to the physical characteristics of conventional jet drive systems in sport boats in the prior art, the drive line angle is typically about 4 degrees or greater. In a conventional watercraft, the positive angle of the drive line translates into an angle of thrust that is directed slightly upward toward the surface of the water, as illustrated in FIG. 2. The upward thrust angle has a tendency to push the bow of the watercraft out of the water. In other words, the positive drive line angle tends to lift the bow of the sport boat during operation.

U.S. Pat. No. 5,984,740 (the '740 patent) describes and illustrates a personal watercraft 10, which incorporates a jet propulsion drive configured according to the teachings of the prior art. As illustrated in FIG. 3 of the '740 patent, the impeller shaft 56 is angled upwardly from the keel line. The exact angle $\alpha$ of the impeller shaft 56, however, is not disclosed. The '740 patent only discusses the advantages of a positive angle $\alpha$ for operation of the personal watercraft 10 described. (See. e.g. the '740 patent at col. 5, lines 36–48.)

While those skilled in art may appreciate the benefits of a positive drive angle, a phenomenon known as "porpoising" may be detected, at certain speeds, by occupants of certain boats. "Porpoising" refers to a condition where the boat tends to move up and down in the water like the movement of a porpoise when it jumps out of the water. This can create an unpleasant ride for the occupants of the boat.

Conventionally, sport boats powered by jet propulsion units have all had positive drive line angles. In fact, conventional wisdom suggests that anything less than a positive drive line angle will so adversely affect vehicle performance that manufacturers of marine engines have specifically discouraged the incorporation of neutral (0°) or negative drive line angles in boats.

"Porpoising," however, remains a problem with certain boat designs.

Accordingly, a need exists for a watercraft that utilizes a jet drive system with improved stability and reduced "porpoising" to ensure that the occupants of the boat will experience a more comfortable and enjoyable ride.

SUMMARY OF THE INVENTION

It is, therefore, an object of the present invention to provide a watercraft, which provides the advantages of a jet propulsion system, with increased stability and reduced "porpoising," by controlling the angle of thrust of the propulsion unit relative to the keel line.

One embodiment of the present invention provides a watercraft including a hull with a keel and a jet drive power source. The jet drive power source includes an engine, an engine output shaft, and a jet propulsion unit. The jet propulsion unit includes a water passage, a drive shaft, an impeller, and a jet port. The engine output shaft is operationally connected to the drive shaft. The jet drive power source is configured to produce power along a predetermined direction and form a drive line based upon the predetermined direction. The drive line bisects a plane of the keel at a predetermined, preferably negative, angle.

Other embodiments of the present invention will be discussed in or will be made apparent from the description that follows.

BRIEF DESCRIPTION OF THE DRAWINGS

The accompanying drawings, which are incorporated in and constitute a part of the specification, illustrate embodiments of the invention and, together with the general description given above and the detailed description of the embodiments given below, serve to explain the principles of the present invention. In the figures.

DETAILED DESCRIPTION OF THE PREFERRED EMBODIMENTS

Throughout the description of the several embodiments of the present invention, reference will be made to various elements, the construction of which is readily known to those skilled in the art. Accordingly, an exhaustive description of each and every component is not provided, only a description of those elements required for an understanding of the present invention.

Figure 1:
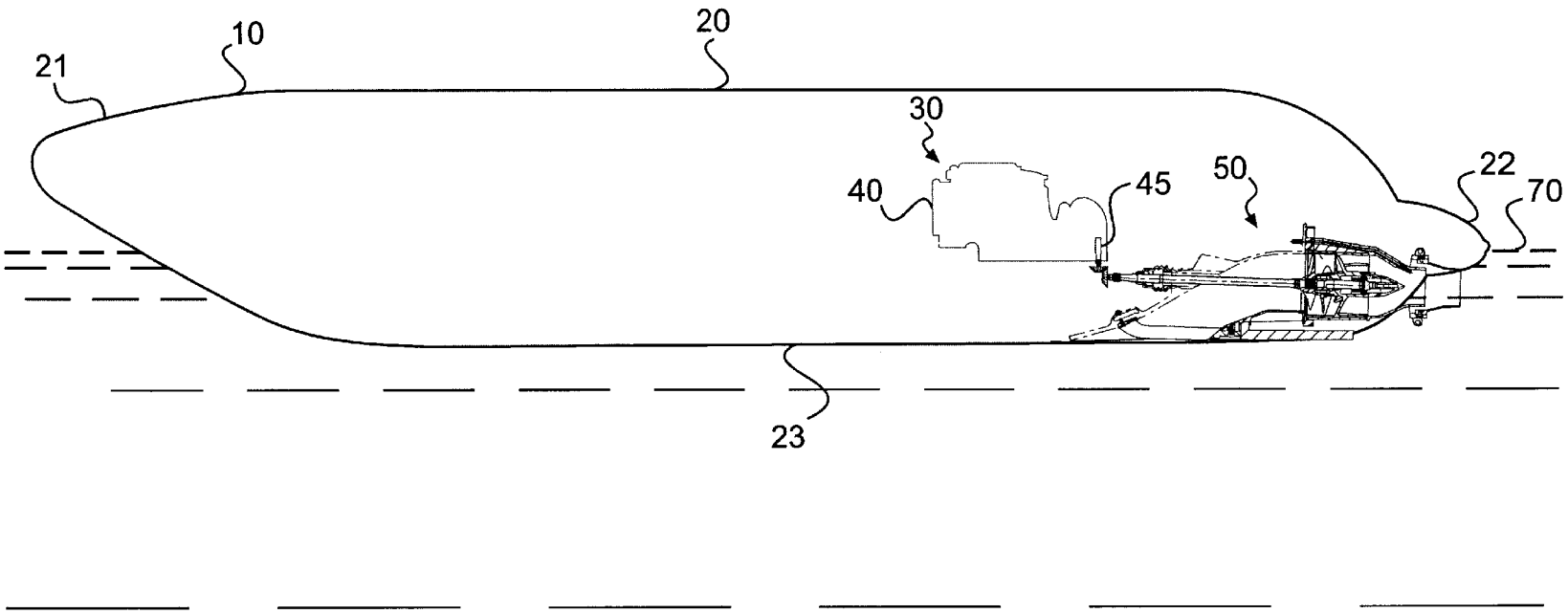
FIG. 1 is a cross-sectional side view of the watercraft of the present invention.

FIG. 1 is a side view of a watercraft 10 of the present invention. In the preferred embodiment, the watercraft 10 is a jet boat that includes a hull 20, with a bow 21, a stern 22, and a keel 23. The watercraft illustrated in FIG. 1 is a sport boat. The details of the sport boat have been omitted because they are not relevant to the present invention. As those of ordinary skill in the art will appreciate after reading the description set forth below, the present invention may be employed on any style jet-propelled boat, regardless of the size, style, or configuration.

In the preferred embodiment, the watercraft 10 of the present invention is powered by a jet drive power source 30. The jet drive power source 30 of the present invention provides for an improved boat ride by comparison with a conventional, propeller-driven watercraft.

Figure 3:
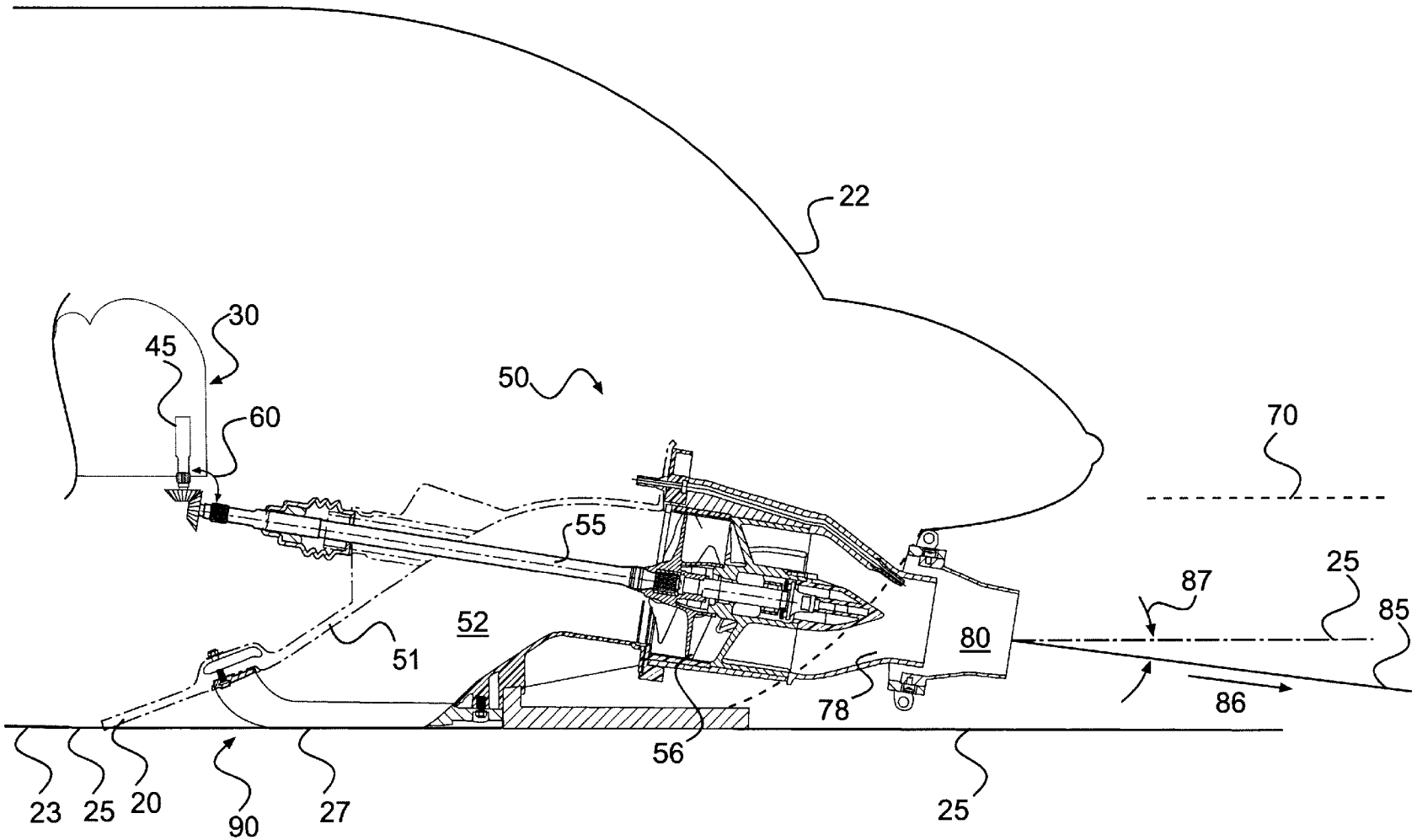
FIG. 3 is a detailed cross-sectional view of one embodiment of the jet drive system of the present invention.
Figure 4:
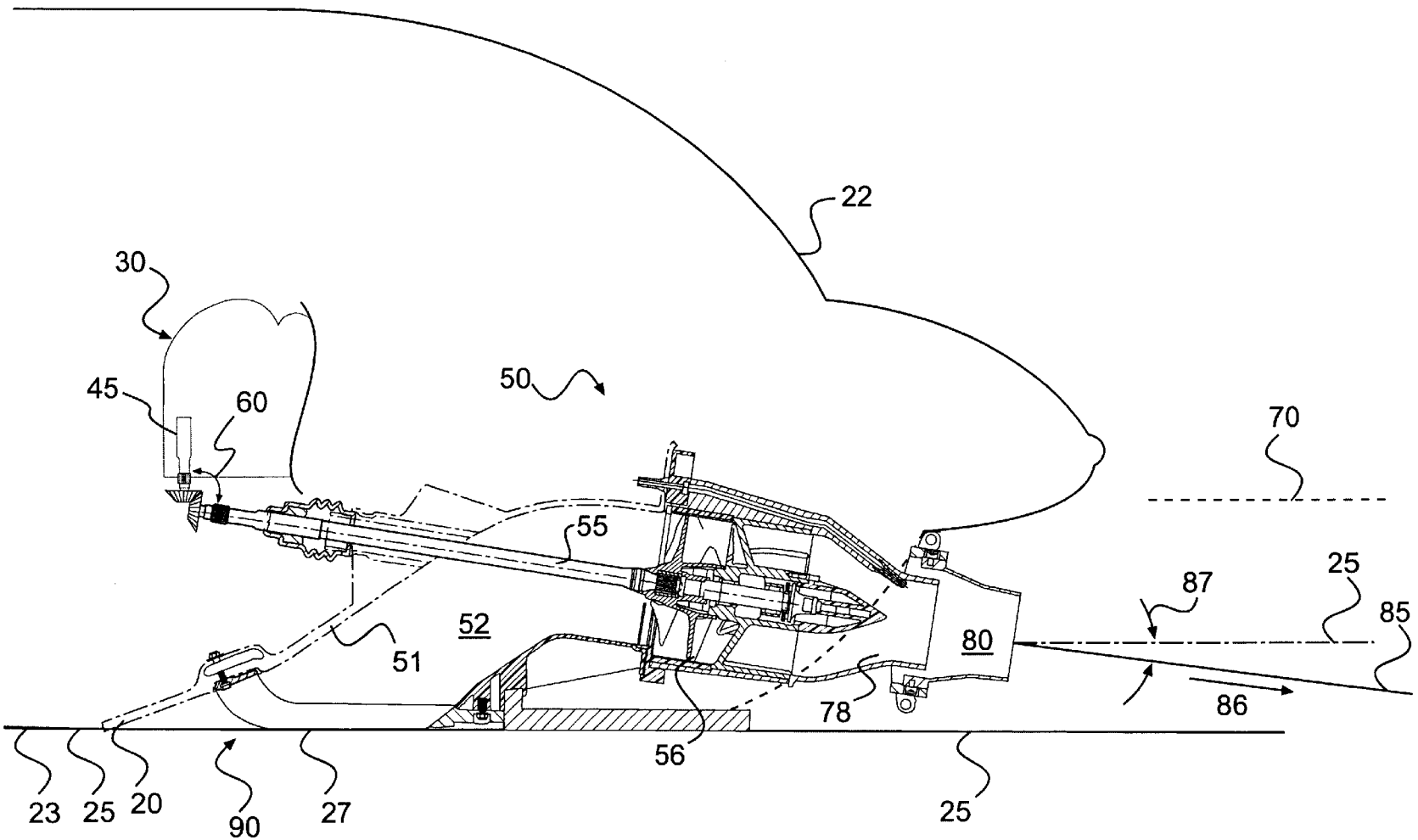
FIG. 4 is a detailed cross-sectional view of an alternate embodiment of the jet drive system of the present invention as illustrated in FIG. 3.

As shown in general detail in FIG. 1, and in greater detail in FIGS. 3 and 4, the jet drive power source 30 includes an engine 40 with an output shaft 45 and a jet propulsion unit 50. The engine 40 may be, but is not limited to, a two-stroke or a four-stroke, inboard, internal combustion engine.

Referring to FIGS. 3 and 4, the jet propulsion unit 50 comprises a housing 51 with a water passage 52 defined by the housing 51, an intake 90, an drive shaft 55, an impeller 56, and a jet port 80. Although the housing 51 can be a separate piece that is mounted to the hull 20, the housing 51 is preferably integrally formed as part of the hull 20.

The engine 40 is operatively connected to a jet propulsion unit 50 through its output shaft 45. The output shaft 45 is rotationally connected to the drive shaft 55, located within the jet propulsion unit 50, such that the output shaft 45 and the drive shaft 55 are not substantially parallel. That is, an angle 60 is formed between the longitudinal axis of the output shaft 45 and the longitudinal axis of the drive shaft 55 such that the angle 60 is greater than zero. As would be appreciated by those skilled in the art, however, the output shaft 45 and the drive shaft 55 could be disposed so that they are substantially parallel (either coaxial or coplanar) to one another.

As defined herein, in the preferred embodiment, the angle 60 formed between the longitudinal axis of the output shaft 45 and the longitudinal axis of the drive shaft 55 will, by definition, be between about 5 degrees to about 175 degrees, no matter the configuration between the engine 40 and the jet propulsion unit 50. Preferably, the angle 60 will be between about 45 degrees to about 135 degrees. Most preferably, the angle 60 will be about 90 degrees and the output shaft 45 will have a generally vertical orientation.

In the embodiments illustrated, the output shaft 45 and the drive shaft 55 are located in the same longitudinal plane that bisects the hull 20 from the bow 21 to the stern 22. Alternatively, the output shaft 45 and the drive shaft 55 may be located in a plane that is either parallel to, or intersects with the longitudinal plane that bisects the hull 20 from the bow 21 to the stern 22.

Disposed within the jet propulsion unit 50 is a water passage 52. During normal operation of the watercraft 10, water enters the passage 52 at an intake 90 located at the bottom of the hull 20. The water enters the passage 52, passes by an impeller 56 and exits the passage 52 through a nozzle 78 and then through a jet port 80. Depending on the speed of the watercraft 10, the jet port 80 may or may not operate below the waterline 70 of the watercraft 10. Normally, at slow speeds, the jet port 80 usually operates beneath the waterline 70.

The jet port 80 typically is a steerable nozzle connected, usually via cables, to the helm of the watercraft 10. As the operator changes the helm direction, so, too; does he/she change the direction of jet port 80. In this manner, the operator changes the travel direction of the watercraft 10.

As illustrated in FIGS. 3 and 4, the nozzle 78 and the jet port 80 for the jet drive power source 30 generate a force along the drive line 85 in a rearward direction 86. The drive line 85 forms an angle 87 with the keel 23 of the watercraft 10. In FIGS. 3 and 4, a plane 25 defined by the keel 23 is shown at the keel 23 as a solid line and above the keel 23 (for reference) as a dotted line. The plane 25 is laterally oriented, parallel to the keel 23.

In the illustrated embodiments, the central axes of the drive shaft 55, the impeller 56, the nozzle 78, and the jet port 80 are aligned along a common centerline. So aligned, the centerline, which is an extension of the central axis of the drive shaft 55, defines the drive line 85 of the jet propulsion unit 50.

In the illustrated embodiments, the nozzle 78 and the jet port 80 are substantially oriented along the same direction. In other words, both are oriented to direct the force of the jet power source 30 along the drive line 85, which corresponds to the axis of the drive shaft 55. It is possible, however, that the jet port 80 and the nozzle 78 may be oriented with respect to one another so that they are not substantially oriented along the same direction. Regardless, the combined effect of the nozzle 78 and the jet port 80 will establish a drive line 85 with an angular orientation to the plane 25 defined by the keel 23. That drive line 85 typically corresponds to the axis of the drive shaft 55.

As shown in FIGS. 3 and 4, the drive line 85 intersects with the plane 25 of the keel 23 at an angle 87. In the conventional embodiment illustrated in FIG. 2, the drive line 85 forms a positive angle 87 of more than about 4 degrees with the plane 25 of the keel 23.

Figure 2:
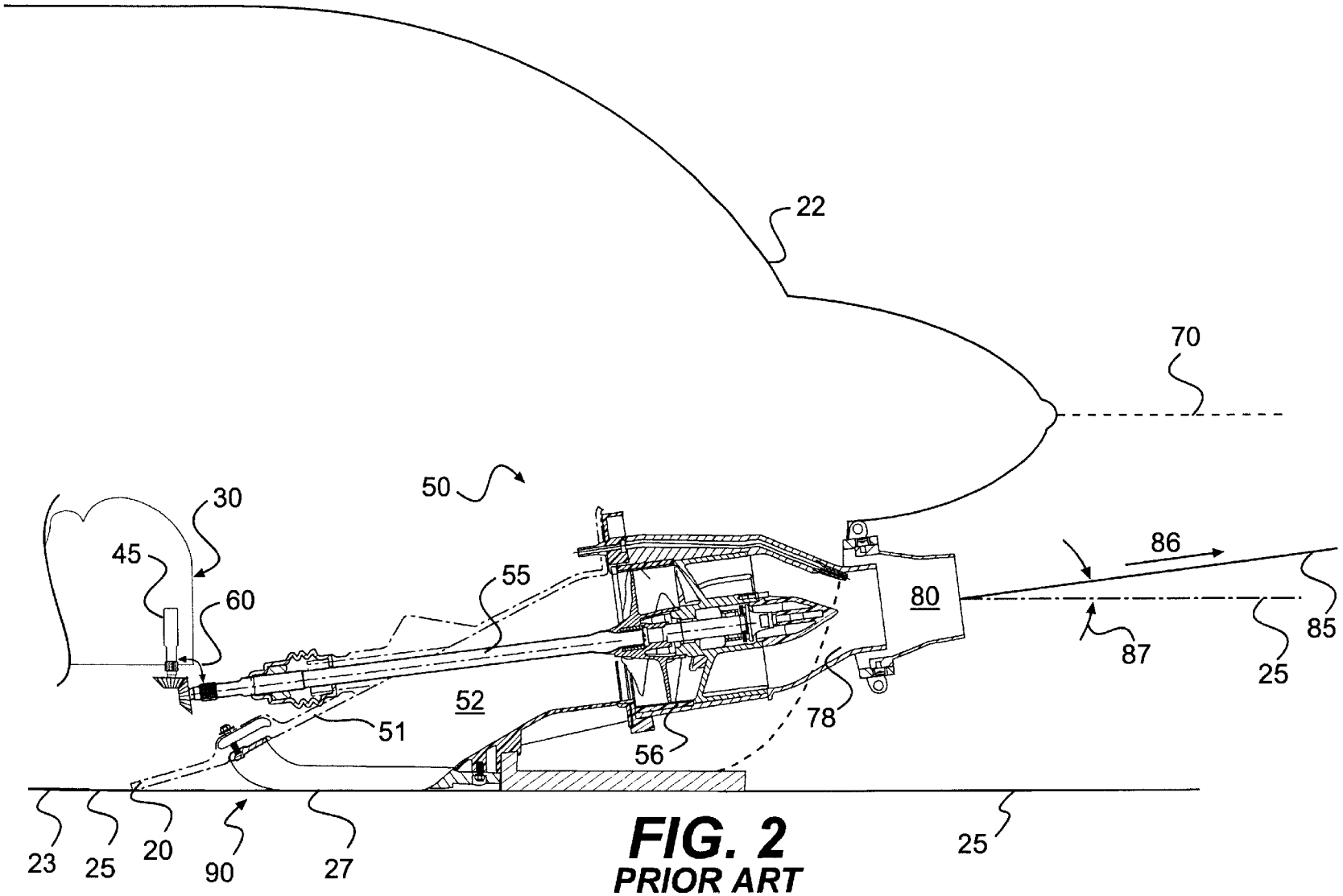
FIG. 2 PRIOR ART
FIG. 2 is a detailed cross-sectional view of the jet drive system of the prior art.

As discussed above, prior to the present invention, those skilled in the art (in particular the jet drive engine manufacturers) believed that the drive line angle must be positive in order for the watercraft to operate properly, as shown in FIG. 2. Anything less than about a 4 degree drive line angle 87 was strongly discouraged.

In certain watercraft designs, however, the positive drive line angle 87 of 4 degrees may create the "porpoising" effect. This problem is acknowledged in the '740 patent, which is discussed above. The reason for this is believed to be as follows. The positive drive line angle 87 has a tendency to push the bow 21 of the watercraft 10 up out of the water. When the watercraft 10 reaches a sufficient speed, enough of the bow 21 of the watercraft 10 extends above the water that the water cannot support the bow 21. In other words, the weight of the bow 21 exceeds the upward buoyant force of the water. This causes the bow 21 to fall into the water until the flow of the water pushes the bow 21 up again to the point where it no longer is in equilibrium with the buoyant force of the water. The repetitive rise and fall of the bow 21 results in "porpoising."

To address the problem of "porpoising," the inventors decided to contravene conventional knowledge and decrease the drive line angle 87 to less than the traditionally-required 4 degrees. After reducing the drive line angle 87 to less than 4 degrees, the inventors discovered that "porpoising" can be reduced significantly or eliminated altogether without affecting the performance of the watercraft 10. This creates a more stable, less bumpy, boat ride. The present invention is intended to encompass watercraft 10 with an angle 87 of less than 4 degrees. Preferably, the predetermined angle 87 is about −5 degrees to about 2 degrees. More preferably, the predetermined angle 87 is about −3 degrees to about 1 degree. Most preferably, the predetermined angle 87 is about −2 degrees to about 0 degrees.

In addition, one skilled in the art would understand that the predetermined angle 87 can be altered in a number of different ways without deviating from the scope of the present invention.

The embodiment illustrated in FIG. 4 differs from the embodiment illustrated in FIG. 3 in that the power source 30 is disposed above the drive shaft 55. In particular, the jet drive power source 30 is positioned above the drive shaft 55 such that a substantial portion of the power source 30 extends over the drive shaft 55 toward the rear of the watercraft 10. In the embodiment illustrated in FIG. 3, the power source 30 is positioned in front of the drive shaft 55. In that embodiment, a substantial portion of the power source 30 extends forwardly of the end of the drive shaft 55 (toward the front of the watercraft 10). The embodiment illustrated in FIG. 4 permits a more compact construction for the jet propulsion unit 50 than the embodiment illustrated in FIG. 3. Accordingly, the jet propulsion unit 50 illustrated in FIG. 4 may be employed in a watercraft 10 where space is more of a concern than the watercraft 10 illustrated in FIG. 3.

From the invention just described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A watercraft comprising:

a hull with a keel; and a jet drive power source disposed within the hull, the jet drive power source being configured to (i) produce power along a predetermined direction and (ii) form a drive line based upon the predetermined direction, wherein the drive line intersects a plane of the keel at a predetermined angle that is less than about 4 degrees;

an output shaft driven by the jet drive power source;

a drive shaft with a first end and a second end, the drive shaft defining a central axis; and a nozzle connected to the hull, the nozzle defining a central axis aligned along a common centerline with the drive shaft central axis, wherein the first end of the drive shaft is rotationally coupled with the output shaft, and wherein the output shaft and the drive shaft are not substantially parallel.

2. The watercraft according to claim 1, wherein the predetermined angle is about −5 degrees to about +2 degrees.

3. The watercraft according to claim 2, wherein the predetermined angle is about −3 degrees to about +1 degree.

4. The watercraft according to claim 3, wherein the predetermined angle is about −2 degrees to about 0 degrees.

5. The watercraft according to claim 4, wherein the predetermined angle is about 0 degrees.

6. The watercraft according to claim 1, wherein an angle formed between the output shaft and the drive shaft is about 5 degrees to about 175 degrees.

7. The watercraft according to claim 6, wherein the angle is about 45 degrees to about 135 degrees.

8. The watercraft according to claim 7, wherein the angle is about 90 degrees.

9. The watercraft according to claim 1, wherein the jet drive power source is disposed above the drive shaft.

10. The watercraft according to claim 9, wherein a substantial portion of the jet drive power source extends over the drive shaft.

11. A watercraft comprising:

a hull with a keel;

a jet drive power source disposed within the hull, the jet drive power source being operatively connected to a drive shaft defining a central axis, the jet drive power source being configured (i) to produce power along the central axis of the drive shaft and (ii) to form a drive line based upon the central axis of the drive shaft, wherein the drive line intersects a plane of the keel at a predetermined angle that is less than about 4 degrees;

a nozzle connected to the hull, the nozzle defining a central axis aligned along a common centerline with the drive shaft central axis; and an output shaft driven by the jet drive power source, wherein the drive shaft has a first and a second end, wherein the first end of the drive shaft is rotationally coupled with the output shaft, and wherein the output shaft and the drive shaft are not substantially parallel.

12. The watercraft according to claim 11, wherein the predetermined angle is about −5 degrees to about +2 degrees.

13. The watercraft according to claim 12, wherein the predetermined angle is about −3 degrees to about +1 degree.

14. The watercraft according to claim 13, wherein the predetermined angle is about −2 degrees to about 0 degrees.

15. The watercraft according to claim 14, wherein the predetermined angle is about 0 degrees.

16. The watercraft according to claim 11, wherein an angle formed between the output shaft and the drive shaft is about 5 degrees to about 175 degrees.

17. The watercraft according to claim 16, wherein the angle is about 45 degrees to about 135 degrees.

18. The watercraft according to claim 17, wherein the angle is about 90 degrees.

19. The watercraft according to claim 11, wherein the jet drive power source is disposed above the drive shaft.

20. The watercraft according to claim 19, wherein a substantial portion of the jet drive power source extends over the drive shaft.

21. A watercraft comprising:

a hull with a keel;

a jet drive power source disposed within the hull, the jet drive power source being configured to (i) produce power along a predetermined direction and (ii) form a drive line based upon the predetermined direction;

a drive shaft operatively connected to the jet power source, the drive shaft defining a central axis; and a nozzle connected to the hull, the nozzle defining a central axis aligned alone a common centerline with the drive shaft central axis, wherein the drive line intersects a plane of the keel at a predetermined angle that is less than about 4 degrees.

22. The watercraft according to claim 21, wherein the predetermined angle is about −5 degrees to about +2 degrees.

23. The watercraft according to claim 22, wherein the predetermined angle is about −3 degrees to about +1 degree.

24. The watercraft according to claim 23, wherein the predetermined angle is about −2 degrees to about 0 degrees.

25. The watercraft according to claim 24, wherein the predetermined angle is about 0 degrees.

26. The watercraft according to claim 21, wherein the jet drive power source is disposed above the drive shaft.

27. The watercraft according to claim 26, wherein a substantial portion of the jet drive power source extends over the drive shaft.

28. The watercraft according to claim 1, further comprising a jet port defining a central axis also aligned along the common centerline with the drive shaft central axis.

29. The watercraft according to claim 11, further comprising a jet port defining a central axis also aligned along the common centerline with the drive shaft central axis.

30. The watercraft according to claim 21, further comprising a jet port defining a central axis also aligned along the common centerline with the drive shaft central axis.

* * * * *